US007955486B2

(12) United States Patent
Yu et al.

(10) Patent No.: US 7,955,486 B2
(45) Date of Patent: Jun. 7, 2011

(54) ELECTROCHEMICAL DEPOSITION PLATFORM FOR NANOSTRUCTURE FABRICATION

(75) Inventors: Min-Feng Yu, Champaign, IL (US); Abhijit P. Suryavanshi, Worthington, OH (US)

(73) Assignee: The Board of Trustees of the University of Illinois, Urbana, IL (US)

( * ) Notice: Subject to any disclaimer, the term of this patent is extended or adjusted under 35 U.S.C. 154(b) by 35 days.

(21) Appl. No.: 12/034,365

(22) Filed: Feb. 20, 2008

(65) Prior Publication Data

US 2009/0000364 A1 Jan. 1, 2009

Related U.S. Application Data

(60) Provisional application No. 60/890,787, filed on Feb. 20, 2007.

(51) Int. Cl.
*C25D 5/08* (2006.01)

(52) U.S. Cl. ..... 205/133

(58) Field of Classification Search ..... 205/118, 205/133, 148

See application file for complete search history.

(56) References Cited

U.S. PATENT DOCUMENTS 5,641,391 A 6/1997 Hunter et al.
5,883,762 A * 3/1999 Calhoun et al. ..... 205/119

FOREIGN PATENT DOCUMENTS

JP 9251979 9/1997
JP 2005-349487 12/2005
JP 2005-349496 12/2005
WO WO 2009/036295 3/2009

OTHER PUBLICATIONS

Cai et al. (2005) "Electro Pen Nanolithography," *J. Am. Chem. Soc.* 127(46):16287-16291.

Chen et al. (Web Release Jul. 23, 2003) "Electrodeposition of Platinum on Nanometer-Sized Carbon Electrodes," *J. Phys. Chem. B.* 107:8392-9402.

Deronzier et al. (Jul. 1989) "Functionalized Polypyrroles. New Molecular Materials for Electrocatalysis and Related Applications," *Acc. Chem. Res.* 22(7):249-255.

Diaz et al. (Nov. 1981) "Electrochemistry of Conducting Polypyrrole Films," *J. Electroanal Chem.* 129(1-2):115-132.

Engelken et al. (1985) "Ionic Electrodeposition of II-VI and III-V Compounds," *J. Electrochem Soc.* 132(12):2904-2909.

Georgolios et al. (Jun. 1989) "Pt Electrodeposition on PAN-Based Carbon Fibres," *J. Electroanal. Chem.* 264(1-2):235-245.

Iwata et al. (Jul. 29, 2004) "Nanometer-Scale Metal Plating Using a Scanning Shear-Force Microscope with an Electrolyte-Filled Micropippette Probe," *Jpn. J. Appl. Phys.* 43(7B):4482-4485.

(Continued)

*Primary Examiner* — Luan V Van

(74) *Attorney, Agent, or Firm* — Greenlee Sullivan P.C.

(57) ABSTRACT

Probe-based methods are provided for formation of one or more nano-sized or micro-sized elongated structures such as wires or tubes. The structures extend at least partially upwards from the surface of a substrate, and may extend fully upward from the substrate surface. The structures are formed via a localized electrodeposition technique. The electrodeposition technique of the invention can also be used to make modified scanning probe microscopy probes having an elongated nanostructure at the tip or conductive nanoprobes. Apparatus suitable for use with the electrodeposition technique are also provided.

18 Claims, 12 Drawing Sheets

OTHER PUBLICATIONS

Madden et al. (1995) "Fabrication by Eletrodeposition: Buildings 3d Structures and Polymer Actuators," *IEEE Sixth International Symposium on Micro Machine and Human Science* 77-81.
Madden et al. (Mar. 1996) "Three-Dimensional Microfabrication by Localized Electrocehmical Deposition," *J. Microelectromech. Syst.* 5(1):24-32.
Martin, C.R. (Dec. 23, 1994) "Nanomaterials: A Membrane-Based Synthetic Approach," *Science* 266:1961-1966.
Molares et al. (Jan. 5, 2001) "Single-Crystalline Copper Nanowires Produced by Electrochemical Deposition in Polymeric Ion Track Membranes," *Adv. Mater.* 13(1):62-65.
Said et al. (2004) "Localized Electro-Dposition (LED): The March Toward Process Devlopment," *Nanotechnology* 15:S649-S659.
Suryavanshi et al. (Feb. 6, 2007) "Electrochemical Fountain Pen Nanofabrication of Vertically Grown Platinum Nanowires," *Nanotechnology* 18:105035.
Suryvanshi et al. (Web Release Feb. 21, 2006) "Probe-Based Electromechanical Fabrication of Freestanding Cu Nanowire Array," *Appl. Phys. Lett.* 88:083103.
Tian et al. (Web Release Jun. 20, 2003) "Electrochemical Growth of Single-Crystal Metal Nanowires via a Two-Dimensional Nucleation and Growth Mechanism," *Nano Lett.* 3(7):919-923.
Yum et al. (Web Release Dec. 8, 2007) "Individual Nanotube-Based Needle Nanoprobes for Electrochemical Studies in Picoliter Microenvironments," *ACS Nano* 1(5):440-448.
Zach et al. (Dec. 15, 2000) "Molybdenum Nanowires by Electrodeposition," *Science* 290:2120-2123.
Zubimendi et al. (May 1993) "Early Stages of Platinum Electrodeposition on Highly Oriented Pyrolytic Graphite: Scanning Tunneling Microscopy Imaging and Reaction Pathway," *J. Phys. Chem.* 97(19):5095-5102.
Hu et al. (Jul. 16, 2010) "Meniscus-Confined Three-Dimensional Electrodeposition for Direct Writing of Wire Bonds," *Science* 329(5989):313-316.
Tatarchenko, Y.A. (1993) "Techniques of Pulling from Shaper," In; *Shaped Crystal Growth*, Kluwer Academic, New York, CH.3, pp. 71-165.

* cited by examiner

ELECTROCHEMICAL DEPOSITION PLATFORM FOR NANOSTRUCTURE FABRICATION

CROSS-REFERENCE TO RELATED APPLICATIONS

This application claims the benefit of U.S. Provisional Application 60/890,787, filed Feb. 20, 2007, which is hereby incorporated by reference to the extent not inconsistent with the disclosure herein.

STATEMENT REGARDING FEDERALLY SPONSORED RESEARCH OR DEVELOPMENT

This invention was made with government support under grant DMI-0328162 awarded by the National Science Foundation. The government has certain rights in the invention.

BACKGROUND OF THE INVENTION

This invention is in the field of electrochemical fabrication of nano and micro-sized structures, including metallic, semiconducting, and polymeric structures.

Due to the versatility of electrochemistry for plating and surface finishing of a wide range of materials, the principle of electrochemistry has recently been pursued and applied for the fabrication of various metallic nanostructures.

For example, electrochemical deposition has been used to deposit large arrays of nanostructures in nanoporous templates, such as porous alumina or irradiated polymeric membranes.(C. R. Martin, Science 266, 1961 (1994); M. E. Toimil Molares, V. Buschmann, D. Dobrev, R. Neumann, R. Scholz, I. U. Schuchert, and J. Vetter, Adv. Mater. (Weinheim, Ger.) 13, 62 (2001); M L. Tian, J. U. Wang, J. Kurtz, T. E. Mallouk, and M. H. W. Chan, Nano Lett. 3, 919 (2003)). This template-based deposition typically provides metal nanowires as small as 40 nm in diameter and a few micrometers in length (Tian et al., ibid.).

Most recently, templated electrochemical deposition of metal nanowires on step edges of graphite has also been demonstrated, which produces metal nanowires having diameters as small as 15 nm (M. P. Zach, K. H. Ng, and R. M. Penner, Science 290, 2120 (2000)).

In the traditional probe-based electrochemical deposition method, a sharp conductive probe and a substrate are submerged in an electrolyte plating bath, and the localized electric field applied between the probe and the substrate induces local deposition when the probe is brought very close to the substrate. (R. A. Said, Nanotechnology 15, 649 (2004); J. D. Madden and 1. W. Hunter, J. Microelectromech. Syst. 5, 24 (1996)). The method has shown great potential as a fast and inexpensive way of fabricating arbitrary-shaped, high aspect ratio 3-D microstructures (e.g., columns and helices) on a wide range of conductive and semiconductive substrates. However, structures produced by this method are usually porous and have feature sizes in the tens of micrometers (Said, ibid.) due to the limitation in producing and maintaining a sharp conductive probe and in confining the electric field down to nanoscale dimensions. In addition, electrolyte bath-based deposition is not suitable for devices in which exposure to ionic solution needs to be avoided.

Iwata et al. report a technique of local metal plating using a scanning shear force microscope with a micropipet probe filled with an electrolyte solution (F Iwata, Y. Sumiya, and A. Sasaki, Jpn. J. Appl. Phys., Part 2 43, 4482 (2004)). Both dots and lines were deposited along the surface of a substrate. The smallest dot width reported was 90 nm. The electrochemical deposition was carried out by applying a constant voltage for the modification time under open-loop current control, and the deposited structures are simple surface patterns with no controlled extension in height. Iwata is also listed as the inventor of Japanese Patent Publication No. 2005-349346, which relates to a method of depositing a micro-substance on a substrate. As described in the English abstract, the method involves a micropipet filled with a liquid containing a charged microsubstance and having an electrode inserted into its interior. An electric field is applied between the electrode and the substrate, resulting in the deposition of the microsubstance on the substrate surface due to the electric field induced physical diffusion of the microsubstance. In addition, Iwata is listed as the inventor of Japanese Patent Publication No. 2005-349487, which reports a fine processing method and device in which a voltage is applied between a working fluid and a workpiece using a combination of a scan type shear force microscope and a hollow probe.

Japanese Patent Publication No. JP9251979 reports a minute working device for supplying a local area on a minute solid surface with a fluid without damaging the solid surface.

BRIEF SUMMARY OF THE INVENTION

In an embodiment, the invention provides probe-based methods for formation of one or more elongated structures which extend at least partially upwards from the surface of a substrate. The methods of the invention allow control of the upwards extension or height of the structures. In different embodiments, the elongated structures are nano-sized or micro-sized in the lateral dimension. In different embodiments, the height of the structures can be greater than one micrometer or greater than 5 micrometers.

Such nanostructures in the form of nanowires can be used as interconnects for electronic packaging and/or repair, and as nanoprobes for electronic testing and chemical sensing. The methods of the invention also allow the formation of complex three-dimensional (3-D) nanostructures such as coil antennas. Nano-scale coil antennas can be used for microwave transmission and plasmonics. The methods of the invention also allow fabrication of freestanding nanowire arrays.

The methods of the invention form can form structure(s) of a selected material through an electrodeposition process termed electrochemical fountain pen nanofabrication (ec-FPN). In the electrodeposition process, an external electric current is applied to an electrolytic cell formed by two electrodes in contact with an electrolyte solution.

The schematic in FIG. 1 shows an embodiment of the invention in which a nanopipet-based ec-FPN process is used for platinum deposition. An electrolyte reservoir (10) having a dispensing end (12) with a small aperture (14) acts as the fountain pen (the reservoir is shown as a glass nanopipette in FIG. 1). The anode is formed by a metal wire electrode (20) inserted into the electrolyte (30) inside the nanopipet. At the start of the process (lower left image), the electrically conducting substrate (40) acts as the cathode and a meniscus (32) of electrolyte is formed between the dispensing end of the nanopipet and the substrate. This meniscus defines a volume of electrolyte between the dispensing end of the nanopipet and the substrate. Metal deposition is constrained to the area where this volume of electrolyte contacts the substrate.

At a later stage of the process shown in FIG. 1 (lower right image), the nanopipette is controlled to move up smoothly and continuously. The motion of the nanopipette is synchronized with the rate of metal deposition to maintain a stable formation of the meniscus between the dispensing end of the nanopipette and newly formed deposit. The previously formed deposit (50) acts as the cathode and deposition is constrained to the area where the volume of electrolyte (34) contacts the previously formed deposit.

FIG. 1 also illustrates some key components of the electrodeposition apparatus. A source of electrical potential (60) is used to drive the electrodeposition process, while an electrometer (70) is used to monitor the current between the reservoir electrode and the substrate. An actuator (80) is used to move the electrolyte reservoir with respect to the substrate.

In an embodiment the invention provides a method for forming an elongated structure of a selected material, the structure extending at least partially upwards from the surface of a substrate, the method comprising the steps of:

a. providing an electrically conducting substrate;
b. providing an electrolyte reservoir having a first and a second end, the first end having an aperture size less than or equal to 2 micrometers, the reservoir containing
   i. an electrolyte solution comprising at least one ionic component; the ionic component capable of being electrodeposited to form the selected material; and
   ii. a reservoir electrode in electrical contact with the electrolyte solution;
c. applying a potential difference between the reservoir electrode and the substrate such that the substrate has the opposite charge to the ionic component and the reservoir electrode has the same charge as the ionic component;
d. bringing the first end of the electrolyte reservoir sufficiently close to the substrate to establish an electrical current between the reservoir electrode and the substrate, thereby electrodepositing the desired material on the substrate; and
e. increasing the vertical separation between the reservoir and the substrate while maintaining an electrical current therebetween which is constant to within 15%, thereby forming a structure of the selected material which extends at least partially upwards from the surface of the substrate.

In an embodiment, in step e) the electrical current between the reservoir electrode and the substrate is maintained at a value which is constant within 15%, 10%, 5% or 2%. In another embodiment, after an initial stabilization time, the electrical current between the reservoir electrode and the substrate is maintained at a value which is constant within 15%, 10%, 5%, or 2% when the electrical potential is substantially constant. The electrical current may be monitored and controlled with a process control system. The process control system is connected to a device which measures the electrical current in the system. The process control device is also connected to an at least one motion control device.

In one aspect of the invention, the substrate may be a structure such as a scanning probe microscopy tip or microelectrode and the methods of the invention may be used to form a fine extension of the original structure. In an embodiment, the invention provides a method for making a modified scanning probe microscopy probe which comprises a nanowire attached to the probe tip. The invention also provides scanning probe microscopy probes made by the methods of the invention. Such conductive probes with high aspect ratios are useful for critical metrology imaging and nanoscale electrical probing applications In another embodiment, the invention provides a method for forming an electrically conducting nanoprobe which comprises a conductive nanowire connected to a conductive wire of larger diameter. The invention also provides electrically conducting nanoprobes made by the methods of the invention. Such a nanowire electrode can be used for biological and cellular probing, where the nanowire can be used to penetrate through the cell membrane, and to apply electric pulses and measure electrochemical potentials in local nanoscale environments In an embodiment, the invention provides an apparatus for electrodeposition of an elongated structure extending at least partially upwards from the surface of a substrate, the apparatus comprising:

a. an electrolyte reservoir having a first and a second end, the first end having an aperture size less than or equal to 2 micrometers;
b. a reservoir electrode located at least partially within the electrolyte reservoir;
c. a source of electrical potential connected between the reservoir electrode and the substrate;
d. an electrical current measuring device capable of measuring the current between the reservoir electrode and the substrate;
e. a motion control device operably connected to control the motion of at least one of the electrolyte reservoir and the substrate; and
f. a process control system operably connected to both the electrical current measuring device and the motion control device.

DETAILED DESCRIPTION OF THE INVENTION

Figure 1:
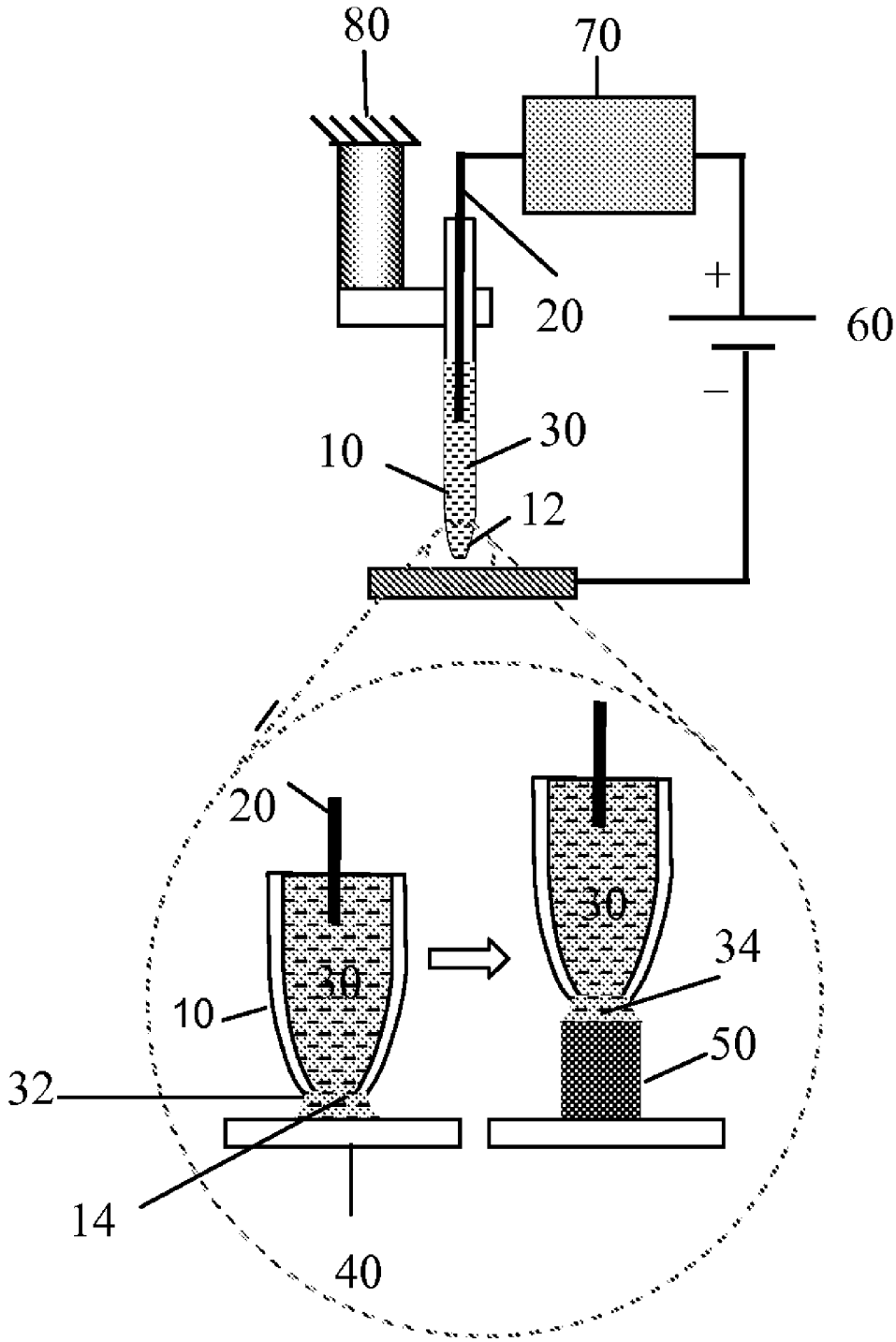
FIG. 1 is a schematic of the electrochemical deposition process.

The methods of the invention can be used to form one or more nanostructures, also referred to as nano-sized structures. As formed, the nanostructures are attached to a substrate. As used herein, a nanostructure has at least one dimension in the range between 1 nm and 1000 nm. In an embodiment, the nanostructure is elongated, having a length (axial dimension) greater than its width (lateral dimension). In an embodiment, the lateral dimension (such as the diameter) in the range from 1 nm to 1000 nm, from 50 nm to 750 nm, or from 50 to 500 nm. In an embodiment, the nanostructure is substantially nonporous. In an embodiment, the nanostructure is a nanowire. As used herein, a nanowire is a solid elongated column-like structure. The nanowires of the invention may display some variation of lateral dimension or diameter along the length of the nanostructure. In an embodiment, the nanowire is broader at the substrate end than the free end. In different embodiments, the aspect ratio (ratio of length to diameter) of the nanowire is greater than 5, greater than 10 or greater than 100. A nanowire may be straight, bent or coiled. In another embodiment, the nanostructure is a tube, having an interior passage or lumen. Either the inner diameter or the outer diameter of the tube may have a dimension between 1 nm and 1000 nm.

The methods of the invention can also be used to form one or more micro-sized structures. As used herein, a micro-sized structure has at least one dimension in the range between 1 micron and 1000 micron. In an embodiment, the micro-sized structure is elongated and has a lateral dimension (such as a diameter) in the range between 1 micrometer and 10 micrometers or between 1 micrometer and 5 micrometers. In different embodiments, the micro-sized structure is a wire or tube.

The elongated structures of the invention extend at least partially or fully upwards or away from the surface of the substrate. As used herein, a structure extending at least partially upwards or away from the substrate extends at least partially in a direction perpendicular to the surface of the substrate (vertical or z direction). The structures of the invention differ from structures which are deposited solely or wholly on the surface of the substrate. In an embodiment, a structure of the invention extends upwards so that the height of the structure above the substrate surface is at least greater than the lateral dimension of the structure (e.g. the diameter of the structure). In other words, the longitudinal axis of each structure is oriented so that it is not completely parallel to the surface of the substrate. In different embodiments, the height of the structure is greater than 250 nm, greater than greater than 500 nm, greater than one micrometer, or greater than 5 micrometers.

Structures provided by the invention include substantially straight nano or micro-sized wires or tubes whose longitudinal axes are substantially perpendicular to the surface of the substrate (where the structure is attached to the surface). FIGS. 2*a*-2*d* show examples of such structures. Structures provided by the invention also include those whose longitudinal axes are neither parallel nor perpendicular to the surface of the substrate at the site of attachment of the structure. In an embodiment, the angle between the longitudinal axis of the structure and the plane of the substrate at the point of attachment is greater than or equal to 15 degrees. Structures of the invention also include curved or bent nano or micro-sized wires or tubes whose longitudinal axis has a varying orientation with respect to the surface of the substrate.

In the present invention, the structures are formed via an electrodeposition process. As used herein, electrodeposition is the process of depositing a material on a surface by the action of electric current. In the electrodeposition processes of the invention, an external electric current is applied to the electrolytic cell formed by two electrodes in contact with the electrolyte solution. One electrode is located in the interior of the electrolyte reservoir. The other electrode is initially formed by the substrate, but is later formed by the electrodeposited material. Both the substrate and the electrodeposited material have sufficient electrical conductivity (no smaller than $10^4$ S/m) to enable the electrodeposition process to proceed.

Metal deposition can be achieved by putting a negative charge on the surface and contacting it with a solution which comprises positive ions of the metal to be deposited (in other words, the surface to be plated is made the cathode of an electrolytic cell). Since the metallic ions carry a positive charge, they are attracted to the negatively charged surface. When they reach the negatively charged surface, it provides electrons to reduce the positively charged ions to metallic form. Suitable metals for deposition include, but are not limited to, copper, platinum, silver, gold, cobalt and nickel. Metal alloys may also be deposited.

Polymer deposition can be achieved by an electropolymerization process. Electropolymerization of conducting polymers such as polypyrroles and polyanilines is known to the art. For example, oxidized pyrrole is positively charged and will be attracted to a negatively charged substrate, thereby forming polypyrrole at the substrate. (A. F. Diaz, J. I. Castillo, J. A. Logan and W.-Y. Lee, Journal of Electroanalytic Chemistry, 129, 115 (1981); A. Deronzier and J.-C. Moutet, Accounts of Chemical Research, 22, 249 (1989)).

Electrodeposition of semiconducting materials is also known to the art. Suitable semiconducting compounds for electrodeposition include II-VI compounds such as CdS and CdTe. (R. D. Engelken and T. P. Van Doren, Journal of the Electrochemical Society, 132, 2904-2909 (1985)).

The methods of the invention form one or more elongated structures through localized electrodeposition. Electrodeposition is localized through formation of an electrolyte meniscus between the surface on which deposition is to occur and the dispensing end of an electrolyte reservoir. This meniscus (the curved upper surface of the electrolyte) defines a volume of electrolyte between the dispensing end of the reservoir and the surface on which deposition is to occur. Without wishing to be bound by any particular theory, electrodeposition is believed to occur only on the portion of the surface in contact with this volume of liquid. To form structures which extend at least partially upwards from the substrate, the electrolyte reservoir and the substrate are moved away from each other during the deposition process (for example, the electrolyte reservoir may be moved upwards with respect to the substrate). The separation may be increased in the vertical (z) direction, or increased in combinations of the z direction with the x and or y directions. In addition, after initial growth of the structure up from the substrate, the structure may bend back down towards the substrate.

In an embodiment, an electrical potential is applied between the reservoir electrode and the substrate before the dispensing end of the electrolyte reservoir is brought sufficiently close to the substrate surface to form the electrolyte meniscus. In an embodiment, the electrical potential is substantially constant during the electrodeposition process. The optimal potential may determined from the CV (cyclic voltammetry) measurement for the specific type of electrochemical reaction.

Figures 3A, 3B, 3C:
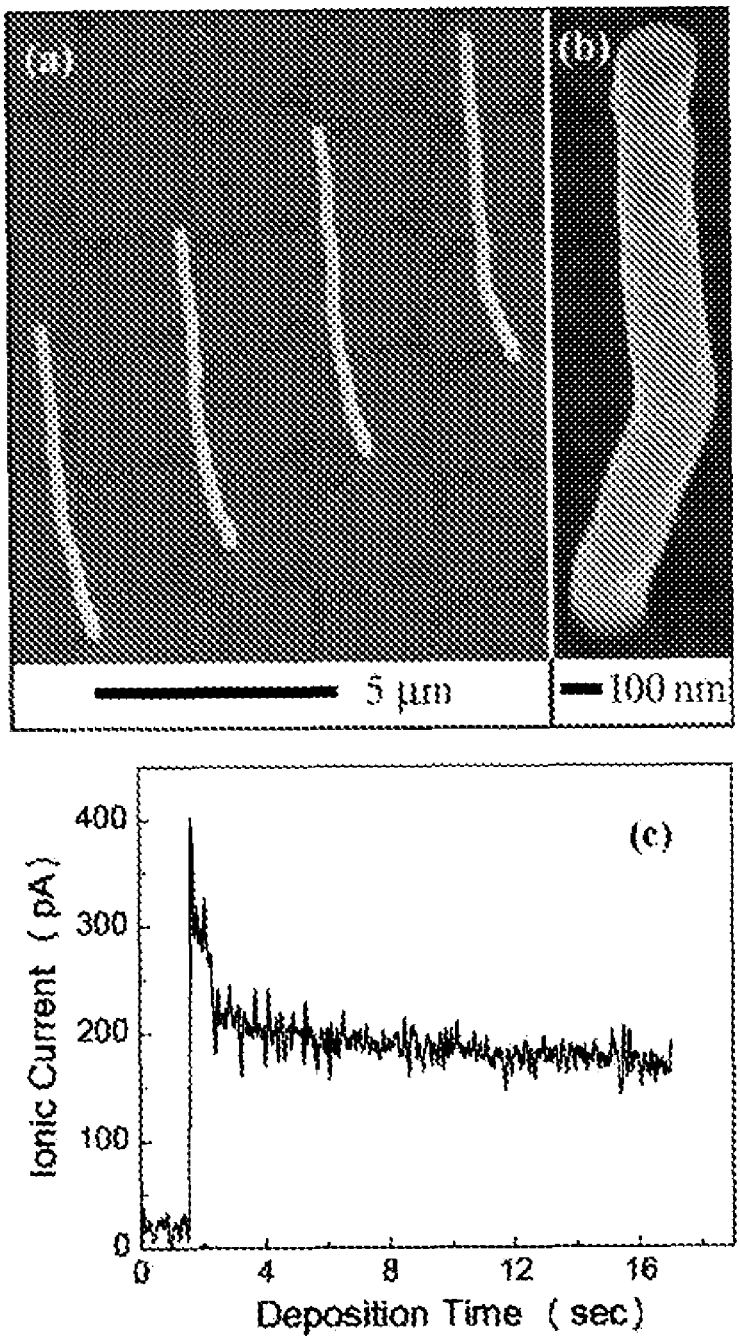
FIG. 3*a* is a SEM image (tilted) showing an array of four Cu nanowires between 200 and 250 nm in diameter and 10 microns in length.
FIG. 3*b* is a SEM isometric view of a Cu nanowire 200 nm in diameter and 3 microns in length.
FIG. 3*c* is a plot of ionic current versus deposition time for deposition of a Cu nanowire.

In an embodiment, the electrical current between the electrode in the electrolyte reservoir and the substrate is measured. As used herein, the term electrical current encompasses flow of ions as well as electrons. The dispensing end of the electrolyte reservoir may be brought into contact with the substrate to form the meniscus. When electrodeposition begins, the current in the electrolytic cell typically shows a sharp increase (see FIG. 3*c*). This increase in current may be used as a signal to start increasing the separation of the reservoir and the substrate. Either or both the reservoir and the substrate may be moved; in an embodiment, the substrate is stationary and the reservoir is moved. Typically, there is a current stabilization or initialization period at the start of the electrodeposition process during which the current through the cell decreases from its initial value to a more constant value (see FIG. 3*c*). Without wishing to be bound by any particular theory, this decrease in current is believed to be due to formation of a diffusion layer. The separation between the reservoir and the substrate will typically be increased during this phase of the electrodeposition process, but the current will typically show more variation than later in the process. In an embodiment, the stabilization period is less than 5 seconds.

To ensure that a meniscus is maintained between the electrolyte reservoir and the deposit, the rate of separation of the electrolyte reservoir and the substrate can be controlled so that there is no interruption of current flow through the electrolytic cell. In an embodiment, the vertical separation between the reservoir and the substrate is increased while maintaining an electrical current therebetween during the initial current stabilization period. In an embodiment, the rate of separation of the electrolyte reservoir and the substrate is controlled so that the current flow through the electrolytic cell is substantially constant after the stabilization/initialization period. In some embodiments of the invention, the current flow through the electrolytic cell will be substantially constant when the electrolytic reservoir is moved away from the substrate at an appropriate constant "pullback" speed. As used herein, a substantially constant/stable current flow can include current variation within 15%, 10%, or 5%. Desirable pullback speeds can be determined by varying the pullback speed and monitoring the ionic current until a stable ionic current is obtained. The process of determining a desirable pullback speed can be automated using control software. The pullback speed may be adjusted during the current stabilization period. A pullback speed determined for a given set of experimental conditions may be suitable for identical or close to identical conditions. In an embodiment, the method for forming the elongated nanostructure comprises the steps of determining a speed of separation between the reservoir and the substrate which, when the electrical potential is maintained at a constant value, permits the electrical current between the reservoir electrode and the substrate to be maintained at a value which is constant to within 15% or 10%, and increasing the separation between the reservoir and the substrate at this previously determined speed.

In different embodiments, suitable pullback speed are 50 nm/sec-500 nm/sec, 50 nm/sec-250 nm/sec, 50-150 nm/sec, or 50 nm/sec-100 nm/sec. In an embodiment, the pullback speed used for deposition of platinum nanowires may be from 50-150 nm/sec. In an embodiment, the pullback speed used for deposition of copper nanowires may be from 150-250 nm/sec. In an embodiment, the electrolytic reservoir and the substrate are separated at a constant "pullback" speed once electrodeposition has been detected. In another embodiment, the pullback speed is more gradually increased and then held at a constant value. For example, the pullback speed may be increased in increments of 25 nm/sec or 50 nm/sec.

If the reservoir is withdrawn from the substrate at higher velocities than those at which continuous and smooth deposition is obtained, the meniscus can break and growth may stopped. Alternately, if the pullback speed is only slightly too high, deposition of "beaded" wires may be obtained (See FIG. 5*c*).

The electrical potential applied between the reservoir electrode and substrate may also be termed the bias voltage. For aqueous electrolyte solutions when the substrate is acting as the cathode, the bias voltage is selected so that it is above the cathodic reduction potential but below the hydrolysis potential of water. It is believed that significant hydrogen bubble formation can agitate the meniscus and prevent stable electrodeposition. Suitable bias voltages to obtain reasonable rates of electrodeposition can be determined through analysis of a cyclic voltammetry (CV) plots.

The reservoir electrode may take various forms. In an embodiment, the reservoir electrode is a conducting wire inserted into the electrolyte solution. In another embodiment, the reservoir electrode can be a conducting element integral with the electrolyte reservoir (e.g. a conducting element made as part of a microfabricated reservoir).

The electrolyte reservoir comprises an aperture through which the electrolyte is dispensed. In an embodiment the electrolyte has two apertures located at opposite ends of the reservoir, a dispensing aperture and a filling aperture. The electrolyte reservoir is adapted so that the electrolyte does not flow from reservoir during the structure formation procedure unless a meniscus is formed between the dispensing end of the reservoir and the surface on which electrodeposition is to occur. In an embodiment of the methods of the invention, no external pressure is applied to the electrolyte to induce electrolyte flow through the dispensing end of the reservoir. The size of the aperture at the dispensing end is selected to produce the desired lateral dimension of the structure; the aperture at the other end of the reservoir is usually larger to facilitate filling of the reservoir with electrolyte solution. The reservoir may be manually filled with electrolyte solution using a syringe inserted into the larger end of the reservoir, or by any other means known to the art. In an embodiment, the aperture at the dispensing end of the reservoir is less than 5 microns, less than or equal to 2 microns, less than or equal to one micron, less than or equal to 750 nm, less than or equal to 500 nm, less than or equal to 200 nm, less than or equal to 100 nm, less than or equal to 50 nm, less than or equal to 25 nm, between 50 and 750 nm, or between 100 and 750 nm. If the electrolyte wets the material of the electrolyte reservoir, the lateral dimension of the meniscus near the dispensing end of the reservoir will typically be larger than the inner diameter (aperture) at the tip of the dispensing end.

In an embodiment, the electrolyte reservoir is a pipet having a dispensing aperture of the desired size. As used herein, the size of the aperture is the diameter of the opening. Typically, nanopipets are cylindrical capillary tubes which have a reduced tip diameter. Glass nanopipets having apertures of 500 nm, 200 nm and 100 nm are commercially available. Electrolyte reservoirs with aperture sizes less than 100 nm, such as 50 nm, may also be suitable for use with the invention.

In an embodiment, multiple electrolyte reservoirs may be used to simultaneously deposit multiple structures. In an embodiment, an array of nanostructures can be formed.

As used herein, an electrolyte solution is a solution comprising an ionic component. Suitable ionic components include metal ions, ions useful in forming compound semiconductors or conducting or semiconducting oxides and monomers or polymers which contain ionic groups or which can be treated to form ionic groups. In an embodiment, the ionic component is an ion of a metal such as copper or platinum. In other embodiment, the ionic component is a monomer such as oxidized pyrrole or aniline. In other embodiment, a plurality of ionic components are used, such as a combination of $Cd^{2+}$ and $S_2O_3^{2-}$ to deposit CdS. The ionic component may be formed by dissociation of an electrolyte in an electrolyte solvent. The electrolyte solution further comprises a solvent. Suitable solvents depend on the nature of the ionic component. In an embodiment, the solvent is water and the solution is aqueous. The electrolyte can also comprise additional components such as additives and acid. In an embodiment, the concentration of the ionic component is varied according to the size of nanowire to be deposited and the type of ionic component used for the deposition.

The evaporation of electrolyte near the dispensing end of the electrolyte reservoir, which is exposed to ambient environment, tends to form crystallites on the tip that can block the aperture and thus prevent further deposition. For aqueous solutions, the humidity of the adjacent environment can be controlled to limit or prevent the crystallization of the solute near the tip. In different embodiments, the humidity is greater than or equal to 20% and less than or equal to 80%, between 30% and 50%, between 40% and 60% or about 50%. Similarly, for nonaqueous solutions the vapor pressure of the solvent can be controlled to limit clogging of the tip.

The concentration of the electrolyte solution affects the rate of electrodeposition, with higher concentrations of the ionic component typically producing higher ionic currents. However, higher electrolyte concentrations can also lead to increased evaporation-induced clogging of the tip.

In an embodiment, the electrodeposited material is polycrystalline. In another embodiment, the electrodeposited material is a single crystal. It is believed single-crystal formation in electrochemical deposition is preferred when the growth of the initial nuclei is faster than the formation of new nuclei. Use of lower electric potentials, higher temperatures, and the absence of additives may encourage formation of single crystals.

The substrate is sufficiently electrically conducting at the deposition location to allow it to act as an electrode. Electrical conductivity may be provided by an electrically conducting coating; the whole of the substrate need not be electrically conducting. In one embodiment, the substrate may be essentially flat and planar. In another embodiment, the substrate is non-planar. For example, the substrate may be the tip of a conductive scanning microscopy probe.

The invention also provides suitable apparatus for performing the electrodeposition methods of the invention. The apparatus comprises at least one electrolyte reservoir and at least one reservoir electrode.

The apparatus also includes at least one process control system which allows monitoring and control of both the current through the electrochemical cell and the relative motion of the electrolyte reservoir and the substrate. The system enables closed loop control of the deposition current. The process control system is operably connected to both a device for measuring the current flow through the electrochemical cell and at least one motion control device. In an embodiment, the process control system comprises a computer program capable of data acquisition and motion control and a data acquisition card. The software program can control the rate of separation of the reservoir and the substrate so that electrical current is maintained between these two elements. As an example, LabVIEW software (National Instruments) may be used to control this aspect of the electrodeposition process.

The apparatus includes at least one motion control device operably connected to the reservoir and/or the substrate or a substrate holder. The motion control device provides for adjustment of the relative positions of the reservoir and substrate during the course of electrodeposition. In particular, the motion control device allows control of the separation of the reservoir and substrate in the direction perpendicular to the face of the substrate at the deposition location (the z direction). In an embodiment, the position of at least one of the electrolyte reservoir or substrate is controlled by a motion-control stage. If the substrate position is controlled by the motion-control stage, the platform of the stage will typically provide the substrate holder. In an embodiment, the reservoir is attached to one or more stages which allow precise control of motion along x, y, and z directions. Coarse motion in x, y, and z directions may be provided by one type of stage and fine motion by another type of stage, as is known to those skilled in the art. Suitable stages for this purpose are also known to those skilled in the art and include, but are not limited to, combinations of Burleigh inchworm stages and piezodriven flexure stages. The relative motion of the substrate and the reservoir is controlled so that the motion is not jerky. In an embodiment, the step size is smaller than 100 nm/s. The quality of motion control can be improved by using smaller step sizes, a better voltage source for driving the piezoelectric stage and better vibration isolation.

The apparatus also includes a source of electrical potential electrically connected to the reservoir and the substrate so as to apply a potential difference between the reservoir electrode and the substrate. Any suitable source of direct current electrical potential known to those skilled in the art can be used. In an embodiment, the source of electrical potential is a power supply. In an embodiment, the allowed variation in the bias voltage for "constant" bias voltage is less than 2%.

The apparatus also includes a device for measuring the flow of ionic current in the electrochemical cell or the electrical current through the external portion of the cell. This current may be measured by any suitable current measuring device known to the art, including an electrometer. The quality of the ion current sensing is affected by the noise performance of the electrometer.

Both the electrolyte reservoir and substrate may be placed in an enclosure to enable humidity control of the atmosphere surrounding the reservoir and substrate. The enclosure may have an inlet to which a humidifier may be connected. A heating device, such as a resistive heater, may be placed inside the enclosure to assist in controlling the temperature at which electrodeposition occurs.

An integrated optical microscope system may be incorporated into the apparatus to provide an optical resolution view of the sample. The optical microscope system can facilitate alignment of the electrolyte reservoir with respect to the substrate.

A vibration isolation device may also be used to improve control of the process. The vibration isolation device is adapted to limit vibration of the substrate, the electrolyte reservoir and typically the motion control device as well. Suitable vibration isolation devices include, but are not limited to, vibration isolation tables.

In Scanning Probe Microscopy (SPM), a probe is scanned across the surface of an object. Typically, the probe includes a sharp tip which is mounted on a flexible cantilever, allowing the tip to follow the surface profile. In one aspect of the invention, the invention provides a modified SPM probe in which a conducting nanowire is formed on a conventional conducting SPM probe. The tip of the probe may be viewed as comprising a first conductive tip portion (supplied by the conventional SPM probe) attached to the cantilever and a second nanowire tip portion (supplied by the electrodeposition processes of the invention) attached to the first tip portion. The nanowire is attached at the apex of the first tip portion, which is the end of the first tip portion which is not attached to the cantilever. Typically, the first tip portion is tapered, with the lateral dimension of apex portion being smaller than the lateral dimension away from the apex portion. In an embodiment, the lateral dimension of the nanowire is less than or equal to the largest lateral dimension of the first tip portion. The high aspect ratios provided by the nanowire can be useful in a variety of applications.

In an embodiment, the nanowire is a metallic nanowire and the first tip portion is coated with a metallic thin film. Usually other portions of the probe will be coated with the metallic thin film if the first tip portion is coated. In an embodiment, the whole probe may be coated with the metallic thin film. Generally, thin films can have thicknesses from fractions of a nanometer to several microns. However, for coated SPM probes the thickness of conductive thin film is typically less than one micron. In different embodiments, the thickness of the metallic thin film is from 1 nm to 100 nm, from 1 nm to 50 nm, from 5 nm to 100 nm, or from 5 nm to 75 nm. Because of the nature of the electrodeposition process, good electrical contact and a strong bond can be made between the deposited metallic nanowire and a metallic coating on the tip of the conventional SPM probe. In different embodiments, the bond can withstand 5 MPa, 8 MPa, or 10 MPa of separation force per unit area. Typically, the nanowire is directly attached to the metallic coating (without intermediate binder or catalyst). In an embodiment, no binder is required to attach the nanowire to the first tip portion.

In an embodiment, the invention provides a scanning probe microscope probe comprising a first tip portion attached to a cantilever, the first tip portion being coated with a metallic thin film and a second tip portion comprising a metallic nanowire formed at the apex of the first tip portion, the metallic nanowire being directly attached to the metallic film of the first probe tip and the diameter of the nanowire being less than or equal to the largest lateral dimension of the first tip portion. In an embodiment, the longitudinal axis of the nanowire is aligned with the longitudinal axis of the first tip portion.

In an embodiment, the invention provides a method for making a scanning probe microscopy probe having a first tip portion and a second tip portion, the second tip portion being a nanowire formed by a method of the invention. In an embodiment, the method comprises the steps of providing a scanning probe microscopy probe comprising a cantilever and a first tip portion attached to the cantilever, the first tip portion being coated with a metallic thin film and forming a metallic nanowire at the apex of the first tip portion, thereby forming a second tip portion attached to the first tip portion. If the cantilever is sufficiently flexible, it may be desirable to gradually increase the pullback speed at the start of the nanowire deposition process.

In another aspect, the invention provides an electrically conducting nanoprobe which can be used as an electrochemical probe or electrode. In an embodiment, the probe may be viewed as comprising two electrodes. One electrode comprises a conducting nanowire. The other electrode comprises an elongated conductor whose lateral dimension is larger than that of the nanowire and an electrically insulating layer surrounding the sides of the conductor. The nanowire is formed at one end of the conducting core of this electrode according to the methods of the present invention, thereby physically and electrically connecting the nanowire to the conducting core. In an embodiment, the lateral dimension of the larger conductor is between 1 and 1000 microns, so that this electrode is a microelectrode. The other end of conducting core is accessible for making electrical connections to external measurement devices. In an embodiment, the side surface of the nanowire is coated with an electrically insulating coating.

In an embodiment, the electrically conductive nanoprobe comprises a metallic elongated conductor having a lateral dimension greater than 1 micron and a metallic nanowire, the nanowire being formed at one end of the elongated conductor. The nanowire has a first and a second end, the first end being connected to the elongated conductor. An electrically insulating coating is attached to and covers the sides of the elongated conductor. An insulating coating may also be attached to all or part of the sides of the nanowire, as well as to the portions of the end of the elongated conductor which are not covered by the nanowire. However, the free end of the nanowire is free of insulating coating after fabrication of the nanoprobe is complete. In an embodiment, the elongated conductor is a wire.

The invention also provides methods for making electrically conducting nanoprobes. In an embodiment, an insulated conductor is provided; one end of the conductor serves as the substrate for nanowire electrodeposition. In an embodiment, the insulated larger diameter conductor may be provided by a metal wire encapsulated inside a glass layer. The encapsulated wire can be made by inserting a commercially available wire into glass tube, and then pulling the glass tube upon heating with a pipette puller. This process yields a pipette having a reduced tip diameter, which encapsulates a metal wire reduced significantly in diameter as well. The tip end with the metal wire can be gently polished to form a flat end. This process is suitable for encapsulation of gold wires. Other techniques for coating metallic wires with insulating coatings are known to the art, including, but not limited to, physical and chemical vapor deposition techniques. If these coating techniques also coat the end of the conductor, the coated conductor may be cut or polished so that the insulating coating does not completely cover the ends of the conductor.

The electrodeposition methods of the invention are used to grow a metallic nanowire off the exposed conducting core. In an embodiment, the longitudinal axis of the nanowire is aligned with the longitudinal axis of the conducting core. Typically, the nanowire is directly attached to the conducting core (without intermediate binder or catalyst). In an embodiment, no binder is required to attach the nanowire to the conducting core. In an embodiment, the conducting core and nanowire are both metallic. Because of the nature of the electrodeposition process, a strong bond and good electrical contact can be made between a deposited metallic nanowire and a metallic conducting core. In different embodiments, the bond can withstand 5 MPa, 8 MPa, or 10 MPa of separation force per unit area.

In an embodiment, the metallic nanowire is at least partially coated with an electrically insulating coating. The electrically insulating coating may be a thin film. In different embodiments, the thickness of the film is less than one micrometer, from 1-100 nm, from 1-100 nm, from 1-50 nm, or from 1-25 nm. In an embodiment, the thin film is conformal. In an embodiment, the insulating coating may be a polymer coating deposited with electropolymerization. Electropolymerization coating techniques are known to the art. For example, electropolymerization coating of boron nitride nanotube electrodes with polyphenol is described Yum et al. (2007, ACS Nano, Vol. 1, No. 5, 440-448). Electropolymerization would be expected to coat the exposed portions of the nanowire (including its free end), as well as the joint between the nanowire and the conducting core and portions of the conducting core not covered by the nanowire. To expose the free end of the nanowire, a portion of the insulating coating can be removed. The end of the nanowire may also be exposed by cutting or otherwise removing a segment of the coated nanowire. In an embodiment, the segment of the coated nanowire which is removed or cut away is relatively short compared to the total length of the nanowire. In different embodiments, the segment removed is less than 25%, less than 10% or less than 5% of the total nanowire length. In this embodiment, the portion removed is near the free end of the insulted nanowire. For example, the coated nanowire can be cut with a focused ion beam or by other methods known to those in the art. Cutting the coated nanowire also allows control of the length of the nano-sized portion of the electrode.

The invention also provides a method for making an electrically conducting nanoprobe, the method comprising the steps of:

a. providing an elongated metallic conductor having a lateral dimension greater than 1 micron and a first electrically insulating layer covering the side surface of the elongated conductor, wherein the first insulating layer does not completely cover the ends of the elongated conductor;

b. forming a metallic nanowire at one end of the elongated conductor by a method of the invention;

c. applying a second electrically insulating layer covering the nanowire and the joint between the nanowire and the conductor, thereby electrically insulating the nanowire;

d. cutting a segment off the insulated nanowire, thereby exposing the end of the metallic nanowire.

As used herein, "comprising" is synonymous with "including," "containing," or "characterized by," and is inclusive or open-ended and does not exclude additional, unrecited elements or method steps. As used herein, "consisting of" excludes any element, step, or ingredient not specified in the claim element. As used herein, "consisting essentially of" does not exclude materials or steps that do not materially affect the basic and novel characteristics of the claim. Any recitation herein of the term "comprising", particularly in a description of components of a composition or in a description of elements of a device, is understood to encompass those compositions and methods consisting essentially of and consisting of the recited components or elements. The invention illustratively described herein suitably may be practiced in the absence of any element or elements, limitation or limitations which is not specifically disclosed herein.

Whenever a range is given in the specification, for example, an electron dosage range or a time range, all intermediate ranges and subranges, as well as all individual values included in the ranges given are intended to be included in the disclosure. When a Markush group or other grouping is used herein, all individual members of the group and all combinations and subcombinations possible of the group are intended to be individually included in the disclosure.

One skilled in the art would readily appreciate that the present invention is well adapted to carry out the objects and obtain the ends and advantages mentioned, as well as those inherent therein. The methods and accessory methods described herein as presently representative of preferred embodiments are exemplary and are not intended as limitations on the scope of the invention. Changes therein and other uses will occur to those skilled in the art, which are encompassed within the spirit of the invention, are defined by the scope of the claims.

All references cited herein are hereby incorporated by reference to the extent not inconsistent with the disclosure herewith.

Although the description herein contains many specificities, these should not be construed as limiting the scope of the invention but as merely providing illustrations of some of the presently preferred embodiments of the invention. For example, thus the scope of the invention should be determined by the appended claims and their equivalents, rather than by the examples given.

The invention may be further understood by the following non-limiting examples.

EXAMPLE 1

Electrodeposition of Cu Nanowires

Commercially available glass pipets with aperture sizes of 500, 200, and 100 nm were used. The selected pipet was filled with 0.05 M $CuSO_4$ electrolyte (Transene Inc.) and mounted on a custom made piezo-driven flexure stage which provided fine nanometer resolution linear motion. A Cu electric wire was inserted into the electrolyte inside the pipet and functioned as an anode. A silicon substrate coated with 5 nm/100 nm thick chrome/gold film served as a cathode and the sample surface for the nanowire deposition. Coarse motions in the x, y, and z directions were provided by Burleigh inchworm stages. For the deposition, an electric potential was applied between the substrate and the copper wire inserted into the pipet, and the pipet was moved towards the substrate by the fine and coarse motion stages. The ionic current was measured with an electrometer and monitored by a control system. As soon as the pipet came in contact with the substrate, an electrolyte meniscus was formed between the pipet and the substrate, and a noticeable rise in the measured ionic current was observed, indicating the initiation of the electrochemical deposition of Cu on the substrate. The pipet was then reversed in motion direction and slowly pulled away from the substrate at a constant speed such that the ionic current remained constant in order to produce the deposition of a uniform and solid copper nanowire. The deposition process was fully automated with LABVIEW program and was carried out at room temperature in air.

Figures 2A, 2B, 2C, 2D:
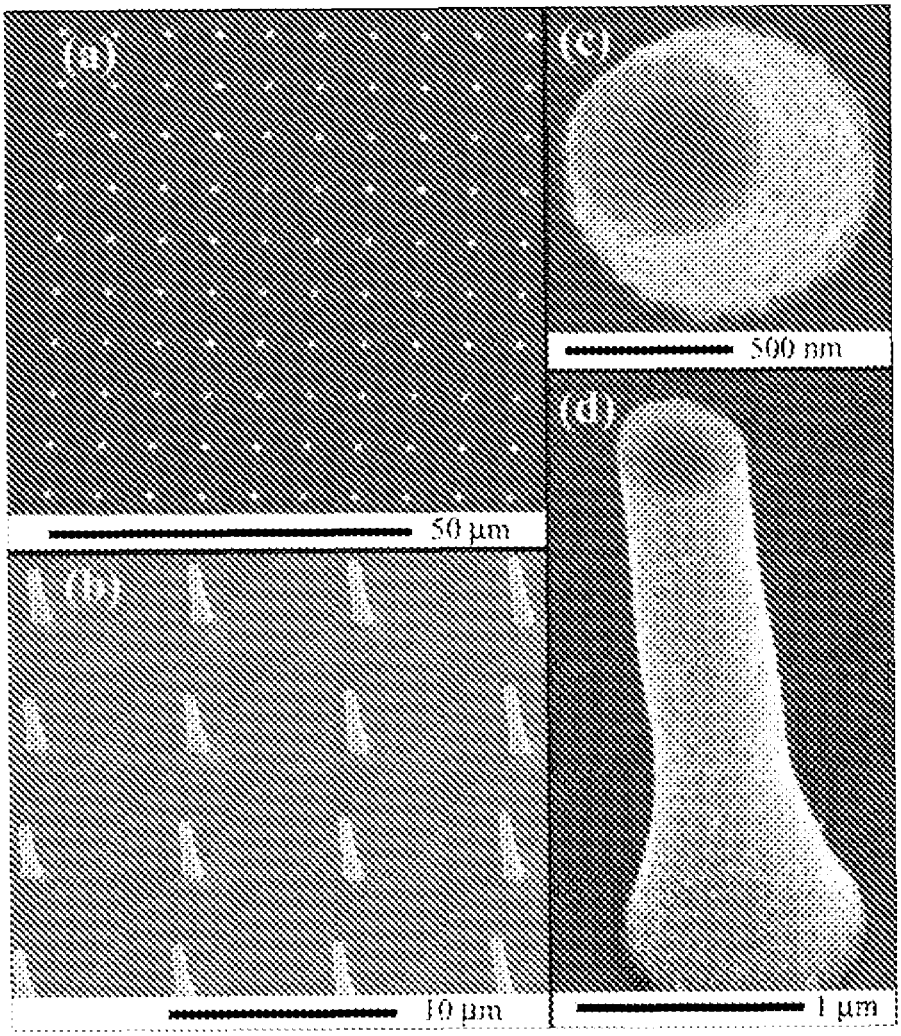
FIG. 2*a* is a scanning electron microscope (SEM) image showing a 10×10 freestanding Cu nanowire array with a grid spacing of 7 microns.
FIG. 2*b* is an isometric view of a smaller section of the array in FIG. 2*a*.
FIG. 2*c* is a top view of an individual Cu nanowire in the array of FIG. 2*a*.
FIG. 2*d* is an isometric view of an individual Cu nanowire in the array of FIG. 2*a*.

FIG. 2 shows a 10×10 freestanding Cu wire array with a grid spacing of 7 microns deposited using a glass pipet having a 500 nm aperture. A constant electric potential of 0.4 V was applied between the probe and the substrate. Stable deposition of Cu wire was realized at a pipet pullback speed of 250 nm/s. The ionic current measured during this deposition process was about 2 nA. As shown in FIG. 2*d*, the Cu wires were uniform with no evident porosity. The length of the Cu wire was about 3 microns and was limited only by the pullback travel range of the piezodriven flexure stage. The diameter of the cylindrical portion of the wire was 645 nm, and its base, being a little bigger: 950 nm. The wire diameter was slightly bigger than the aperture size of the pipet, because the meniscus formed at the tip of the pipet during the deposition process extends beyond the inner aperture. The same has been observed in wires deposited with 100 and 200 nm aperture size pipets. Cu wires deposited with a 200 nm aperture size pipet have an average diameter of 320 nm. The four nanowires shown in FIG. 3(*a*) were deposited with a 100 nm aperture size pipet. The nanowires were 10 microns long, and between 200 and 250 nm in diameter. Deposition of a nanowire tilted at a certain angle up to 60° off the substrate was also realized by synchronizing the motion of the probe and the substrate during the deposition. It is expected that the deposition of more intricate shapes is possible by programming the motion stages to move along a designed path.

The variation in ionic current during the deposition of nanowire is shown in FIG. 3(*c*). As the pipet approaches the substrate, the current-time plot shows a sharp rise when a meniscus is formed between the pipet and the substrate, and when deposition is initiated. The current then decreases, which is believed to be due to the formation of a diffusion layer, and stabilizes at a nearly constant value during growth of the Cu nanowire. The density of the deposits and hence the porosity of the structures can be estimated from the acquired current plot and the dimension of the deposited nanowire according to Faraday's law applied for the related electrochemical reaction $Cu^{2+}+2e^{-}\rightarrow Cu$. By assuming a 100% current efficiency for the electrochemical deposition, the density ρ of the deposit is $$\rho=(QA/FZ)(\pi d^2 l/4)^{-1}\times 10^{-3}$$

(units of $kg/m^3$) where Q is the amount of charge input, d is the diameter and l is the length of nanowire, F is the Faraday constant, Z is the valence number, and A is the atomic weight of Cu. For the current versus time plot shown in FIG. 3(*c*), it took 40 s at an average current of 190 pA to deposit a nanowire of 200 nm in diameter and 10 microns in length as shown in FIG. 3(*a*). The density of the deposit thus calculated is approximately 7970 $kg/m^3$, which compares well with the density of bulk metal Cu (8230 $kg/m^3$), implying the solid and nonporous nature of the deposited nanowires.

Figure 4A:
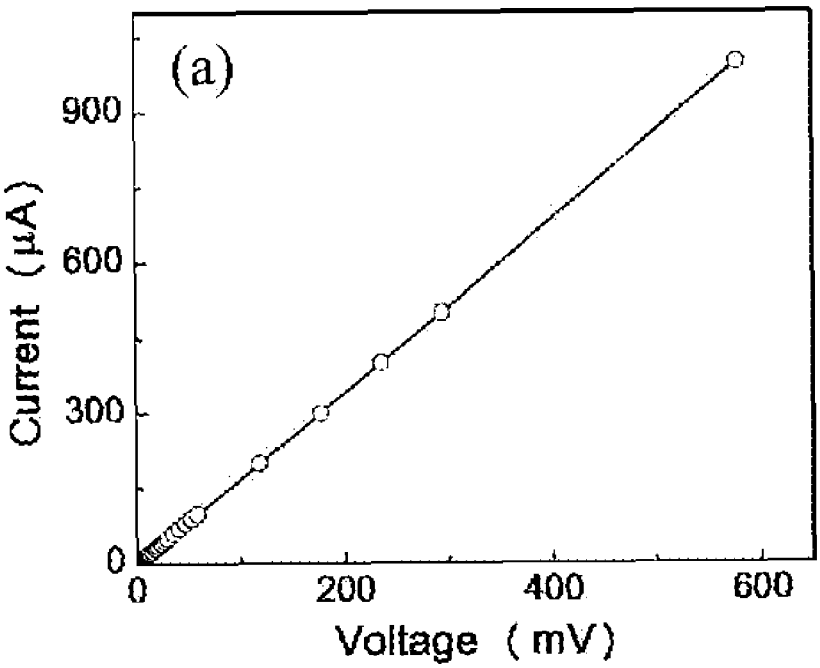
FIG. 4*a* is a current vs. voltage plot acquired from a 500 nm diameter, 10 micron long Cu nanowire.
Figure 4B:
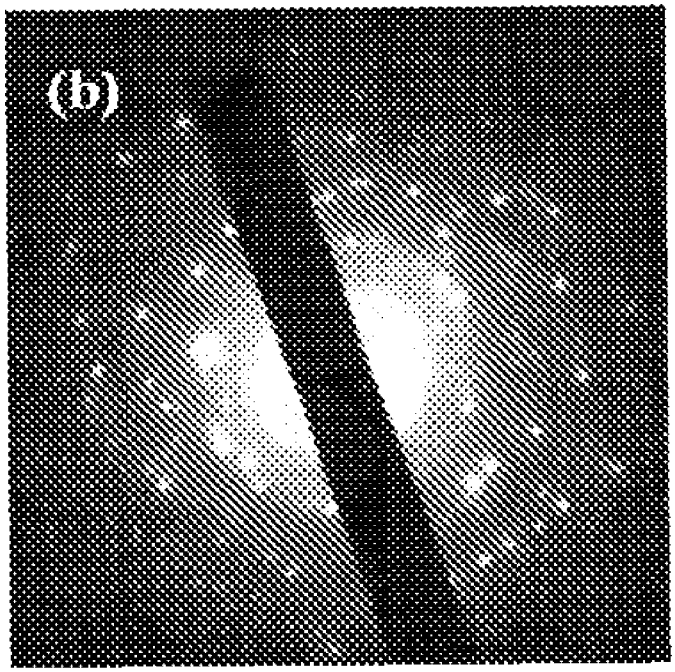
FIG. 4*b* is a transmission electron microscopy (TEM) selected area electron diffraction pattern acquired from a 250 nm diameter Cu nanowire.

The conductivity of the deposited nanowire was characterized with a four-point resistance measurement. A Cu wire 500 nm in diameter and 10 microns in length was picked up from the substrate with manipulation and placed onto a microchip with four electrodes fabricated with photolithography. The wire was connected to the four electrodes with thin platinum leads fabricated with focused ion beam microscopy (FET Strata 235). The measurement was then carried out in a vacuum of $10^{-6}$ Torr. FIG. 4(*a*) shows the acquired I-V curve from the nanowire. The curve was perfectly linear with a slope of 580 Ohms, indicating the metallic nature of the nanowire. The calculated conductivity for the Cu nanowire is $8.7\times10^4$ S/m. The nanowire was capable of carrying a maximum current of 2 mA, giving a breakdown current density of 106 $A/cm^2$ in vacuum. To determine the structure of the Cu nanowires, a 250 nm diameter 10 micron long nanowire was picked up from the substrate and transferred onto a transmission electron microscope (TEM) grid. The selected area electron diffraction pattern from the sample (FIG. 4(*b*)) showed that the nanowire was, as expected, polycrystalline. A clear lattice-resolved TEM image of the whole nanowire was not obtained due to its relatively large diameter, though lattice fringes were visible for some Cu grains in the thin sections of the nanowire.

The deposition process was reliable and repeatable, although infrequent clogging of the pipet at low humidity occurred. If the humidity is low (<30%-35%), $CuSO_4$ crystallizes out of the solution due to the high evaporation rate near pipet tip, and forms a slush-type ball of a mixture of $CuSO_4$ crystallites and liquid at the end of the pipet. The deposition rate can potentially be increased by increasing the applied electric potential and thus increasing the current density. However, the increase of the electric potential causes depletion of the electrolyte and ultimately results in the evolution of hydrogen bubbles at the cathode leading to porous Cu deposits. The decomposition potential for the electrolysis of water is 1.23 V and higher if overpotential is considered. The current density can also be increased by increasing the concentration of electrolyte, although in our experiments, increased concentration tends to clog the pipet frequently due to the crystallization of $CuSO_4$ at the aperture (Suryvanshi, A. P and Yu, M-F; Applied Physics Letters, 88, 2006).

Further details are given in Suryvanshi, A. P and Yu, M-F; Applied Physics Letters, 88, 2006, 083103.

EXAMPLE 2

Electrodeposition of Pt Nanowires

Commercially available glass nanopipets with apertures as small as 100 nm were filled with 5 mM chloroplatinic acid ($H_2PtCl_6$) (pH=1) solution (Sigma-Aldrich Inc.) and used as electrochemical fountain pens. Platinum was chosen for deposition. A two-electrode configuration was used for the electrochemical deposition and the monitoring of electrochemical process (Bard, A. J. and Faulkner, L. R., "Electrochemical Methods: Fundamentals and Applications, 2nd Edition," John Wiley & Sons, Inc, New York, 2001). A 250 μm diameter platinum wire was inserted into the nanopipet to act as the reference electrode during deposition. For convenience in later characterization, the cantilever surface of a conductive (Pt/Ir coated) AFM probe was used as the working electrode and the surface for nanowire deposition. The cantilever of the AFM probe, which has a relatively high spring constant of ~3 N/m, acts just as a rigid substrate, and introduces no obvious uncertainties in the deposition. A 3-axis piezoelectric positioning stage was set up to control the motion of nanopipet precisely with respect to the substrate. When the nanopipet engages and touches the substrate, a sudden rise of the ion current indicates that an electrolyte meniscus has formed between the nanopipet and the substrate. The nanopipet is then withdrawn slowly from the substrate at a constant velocity to produce vertically-grown nanowires.

Figures 5A, 5B, 5C:
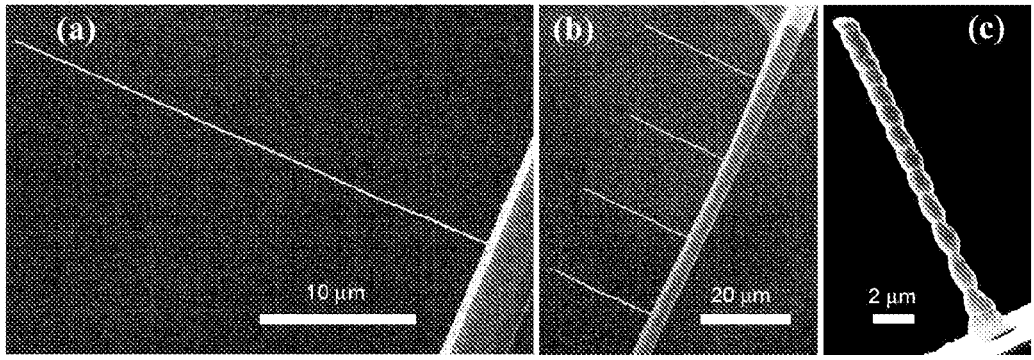
FIG. 5*a* is a SEM image showing a freestanding 150 nm diameter 30 μm long Pt nanowire deposited on a conductive AFM cantilever.
FIG. 5*b* is a SEM image showing four 500 nm diameter 30 μm long Pt nanowires deposited on a conductive AFM cantilever.
FIG. 5*c* is a SEM image showing a beaded Pt nanowire deposited on a conductive AFM cantilever

FIGS. 5*a*-5*c* show vertically-grown Pt nanowires with ec-FPN. The platinum nanowire shown in FIG. 5*a*, which has a diameter of ~150 nm and length of 30 μm, was deposited with a nanopipet having a 100 nm aperture under a relative humidity of 50%. A DC bias of −1 V was applied to the substrate with respect to the platinum reference electrode, and the nanopipet was pulled away from the substrate at a constant velocity of 50 nm/s. The average reduction current during the electrodeposition process was ~0.5 nA. The diameter of the nanowire was larger than the nanopipet aperture because the meniscus extends from the glass wall of the nanopipet rather than from its aperture only. FIG. 5*b* shows four 500 nm in diameter and 30 μm in length Pt wires deposited on an AFM cantilever surface with a pipet of aperture size of 500 nm. The DC bias was −1 V with respect to the platinum reference electrode and the withdrawal speed of the pipet was 100 nm/s. The average reduction current during this deposition was ~1.25 nA.

The nanowire deposition with ec-FPN is sensitive to several important parameters, such as withdrawal speed, electric bias voltage, humidity and electrolyte concentration. If the nanopipet is withdrawn from the substrate at higher velocities than those required for a continuous and smooth deposition, the meniscus can break and the nanowire growth is stopped, or the deposition of beaded wires can result as shown in FIG. 5*c*.

The evaporation of electrolyte near the tip of the pipet, which is exposed to ambient environment, tends to form crystallites on the tip that can block the pipet and thus prevent further deposition. To prevent the crystallization of the solute near the pipet tip, the humidity of the adjacent environment may be controlled in ec-FPN. A relative humidity level of 50% was found to be the most optimal for these experiments. If the humidity was less than 20%, the nanopipet clogged frequently during the electrodeposition.

Figure 6:
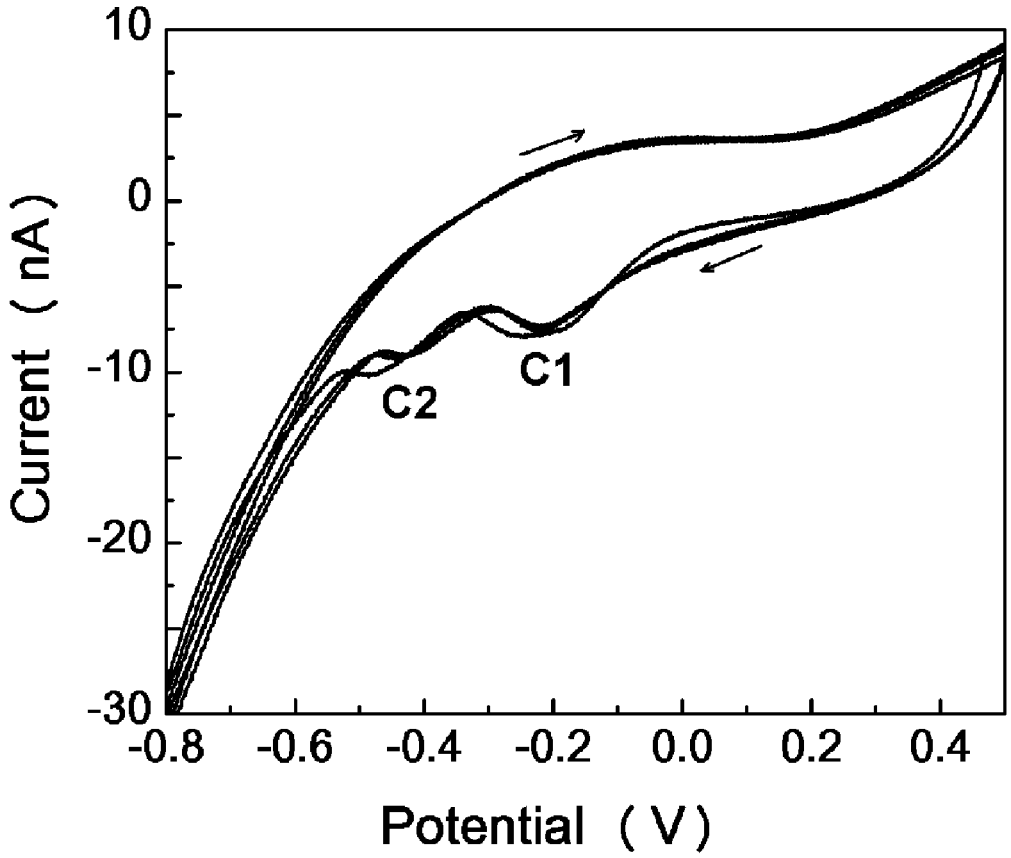
FIG. 6 is a cyclic voltammetry plot (multiple traces) acquired in ec-FPN for 5 mM $H_2PtCl_6$ (pH=1) with respect to a platinum reference electrode at a scan rate of 100 mV/s.

The use of low concentration electrolyte can also mitigate the problem of clogging. On the other hand, lowering concentration also lowers the ion current and the deposition rate as the ionic current is directly proportional to the concentration of the electrolyte (Bard, A. J. and Faulkner, L. R., "Electrochemical Methods: Fundamentals and Applications, 2nd Edition," John Wiley & Sons, Inc, New York, 2001). A concentration of 5 mM was used for the experiments reported in this study. Trial experiments done with 500 nm diameter nanopipets and 50 mM $H_2PtCl_6$ (pH=1) resulted in frequent clogging of nanopipet even at 50% and higher humidity levels; and with 0.5 mM $H_2PtCl_6$ (pH=1), the deposition rate was significantly reduced as expected. The bias voltage was chosen so that it was above the cathodic reduction potential but below the hydrolysis potential of water as significant hydrogen bubble formation can agitate the meniscus and prevent stable deposition of nanowire. The cathodic reduction process for the platinum deposition in ec-FPN can be directly examined with in situ cyclic voltammetry (CV). FIG. 6 shows a typical CV plot obtained in ec-FPN using a 10 μm diameter pipet filled with 5 mM $H_2PtCl_6$ solution with pH=1 and a platinum reference electrode. The potential scan rate for the CV is 100 mV/s. The peaks $C_1$ at −0.2 V and $C_2$ at −0.42 V indicate mostly the reduction of $Pt^{4+}$ to $Pt^{2+}$ and $Pt^{2+}$ to Pt, respectively. As the potential increases further, the reduction current continues to rise due to the deposition of platinum and also hydrogen ions (Georgolios, N.; Jannakoudakis, D. and Karabinas, P., *Journal of Electroanalytical Chemistry* 1989, 264, 235-245; Zubimendi, J. L.; Vazquez, L.; Ocon, P.; Vara, J. M.; E., T. W.; Salvarezza, R. C. and Arvia, A. J., *Journal of Physical Chemistry* 1993, 97, 5095-5102; Chen, S. and Kucernak, A., *Journal of Physical Chemistry B* 2003, 107, 8392-8402. At a reduction potential between −0.9 V and −1 V, the rate of Pt deposition is significant and is found to be the most appropriate for the Pt nanowire growth in this experiment. A similar CV plot was also obtained using a Ag/AgCl electrode as a reference electrode. In this case, the peaks $C_1$ and $C_2$ occur at +0.32 V and +0.1 V respectively and the optimal nanowire deposition potential was found to be between −0.4 V and −0.5 V.

Figures 7A, 7B, 7C, 7D:
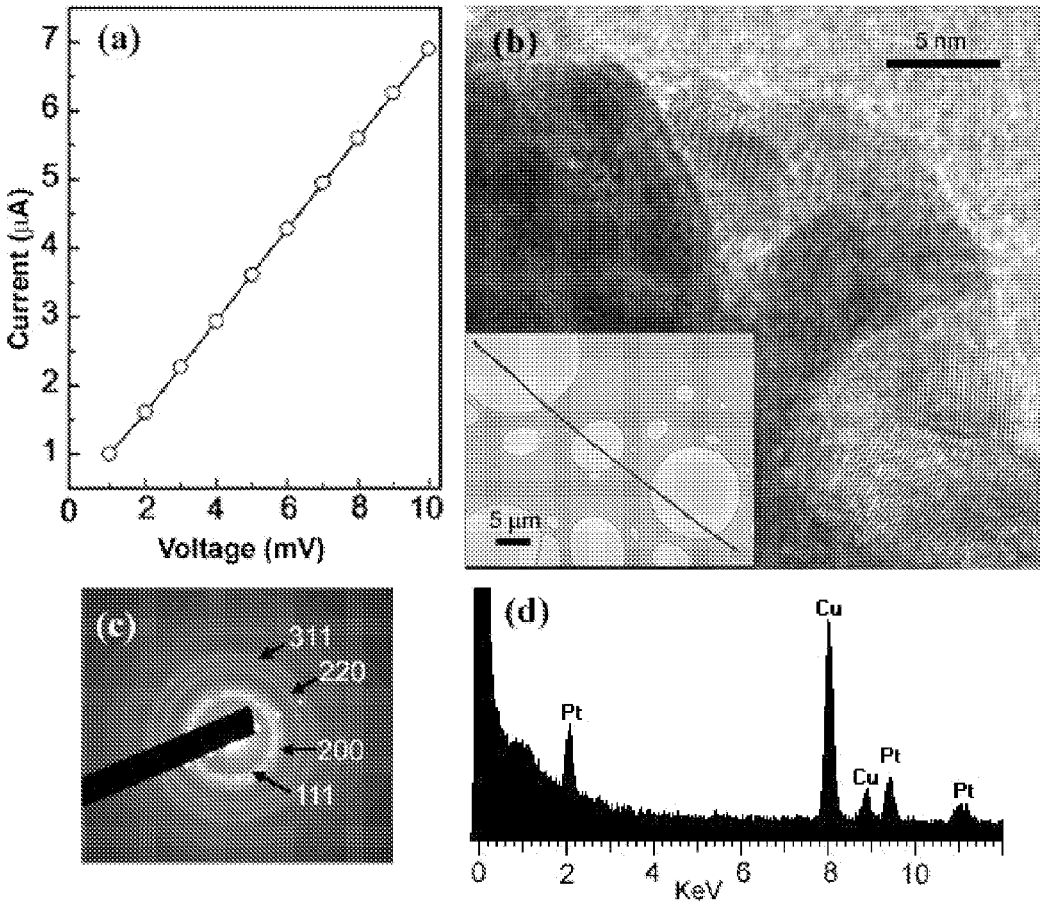
FIG. 7*a* shows a current vs. voltage plot acquired across the nanowire shown in FIG. 5*a*.
FIG. 7*b* is a TEM image showing the polycrystalline grain structure near the end of the Pt nanowire in the inset.
FIG. 7*c* is a TEM selected area electron diffraction pattern acquired from the same nanowire as in FIG. 7*b*.
FIG. 7*d* illustrates an energy dispersive X-ray spectrum acquired from the same nanowire as in FIG. 7*b*.

The electrical and structural qualities of the deposited Pt nanowire were analyzed with two-point resistance measurement and transmission electron microscopy (TEM). A resistance measurement was carried out for the Pt nanowire shown in FIG. 5*a* using two platinum probes with freshly cut surfaces. One platinum probe was placed right behind the spot where the nanowire was anchored to the AFM cantilever surface and the other onto the free end of the nanowire. The IV curve thus acquired (as shown in FIG. 7*a*) gave a resistance of 1.4 kΩ and the resistivity was calculated to be $\sim 8\times10^{-7}\Omega\cdot m$ from the known dimensions of the nanowire, which compared well with the bulk resistivity of Pt, $1\times10^{-7}\ \Omega\cdot m$. The nanowire was then picked and placed on a holey carbon copper grid for TEM analysis. The polycrystalline structure of the nanowire with nanograins was resolved in high-resolution TEM (FIG. 7*b*), and was further confirmed with the ring-pattern seen in the selected area diffraction obtained from the TEM (FIG. 7*c*). The diffraction rings correspond to the (111), (200), (220) and (311) lattice plane of a typical fcc Pt. The elemental analysis with energy dispersive X-ray spectroscopy (FIG. 7*d*) confirmed that the nanowire is composed of platinum. The copper peaks in the plot are due to the TEM copper grid.

Further details are given in Abhijit, S. and Yu, M-F, (2007), Nanotechnology, 18, 10535.

EXAMPLE 3

Electrodeposition of Microsized Metal Tubes

Figure 8A:
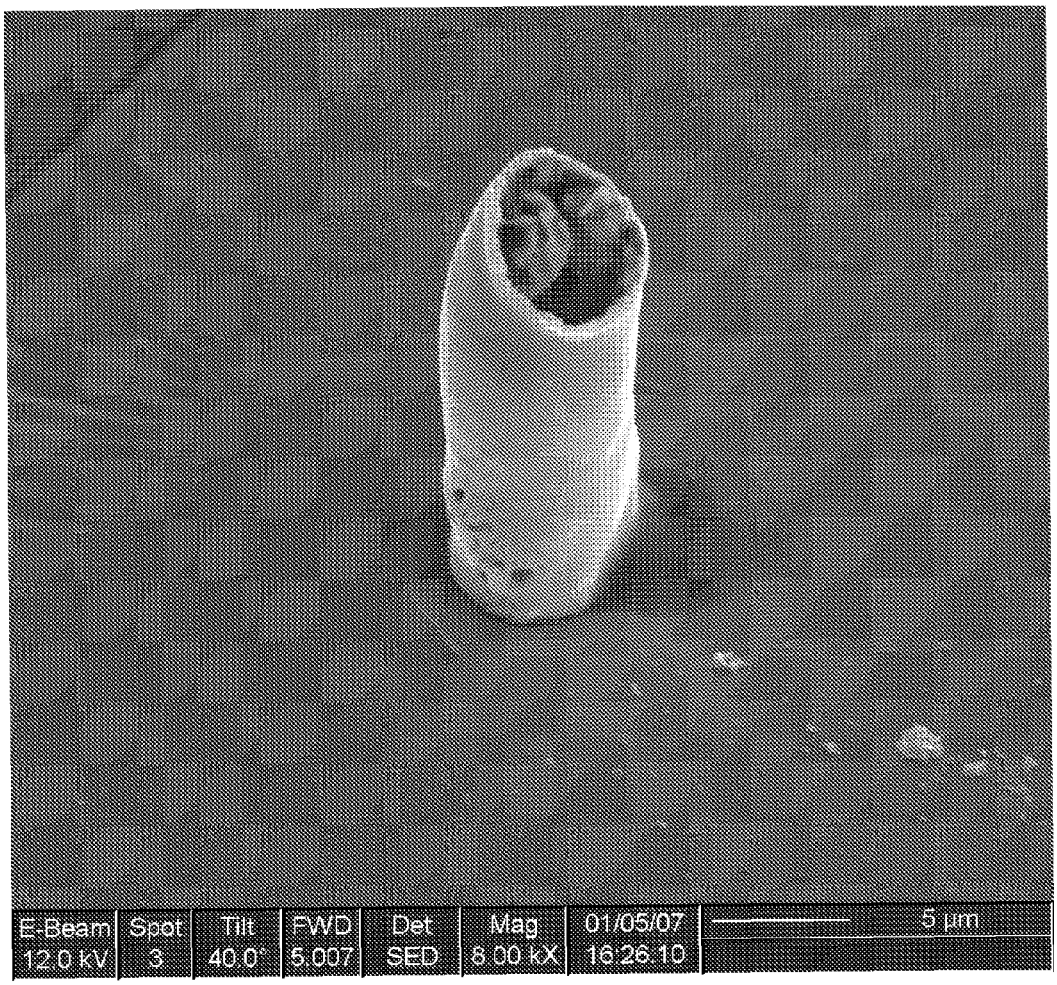
FIG. 8*a* is an SEM image of the exterior of a micron-sized electrodeposited tube.
Figure 8B:
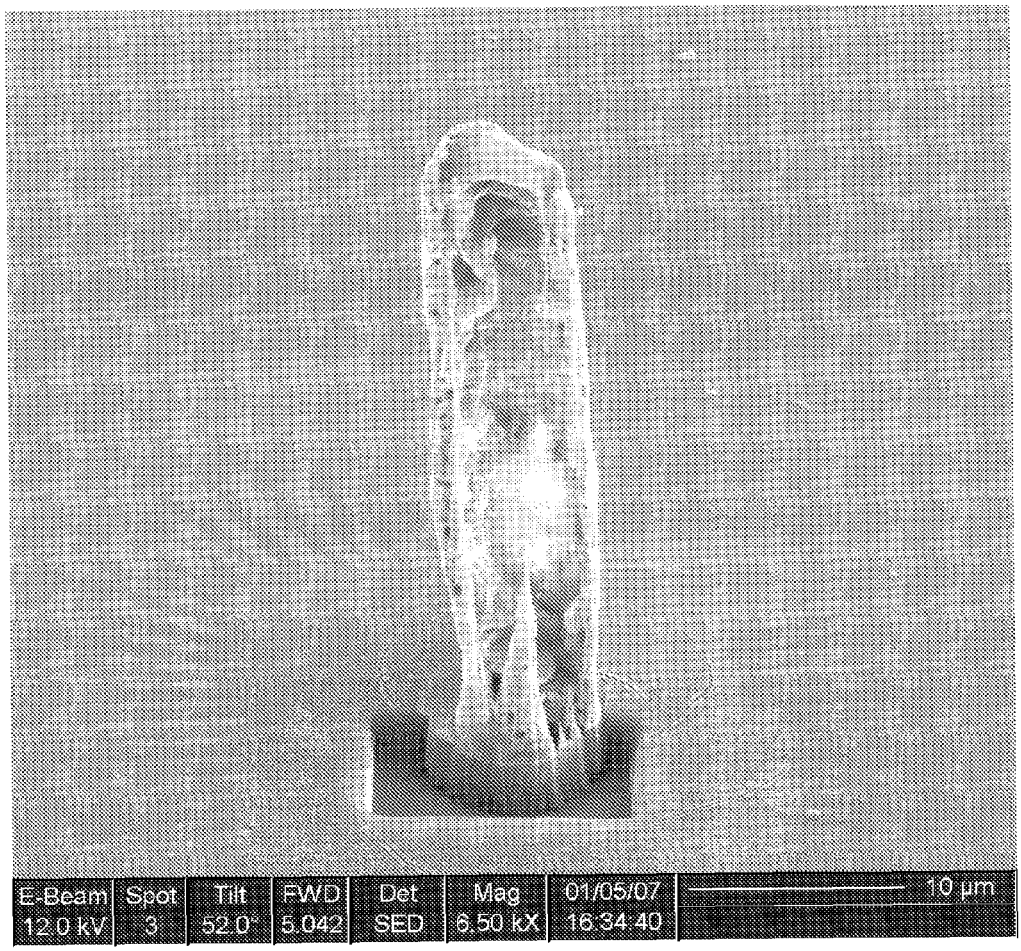
FIG. 8*b* is an SEM image of a cut-away view of the tube in FIG. 8*a*.

Microsized metal tubes have been deposited having an outer diameter of 2 microns and a wall thickness less than 0.5 nm. Experimental conditions were similar to those in Example 1, but the pipette had a larger aperture, approximately 2 microns. FIG. 8*a* shows an SEM image of the outside of the tube; FIG. 8*b* is a cutaway view of the tube in FIG. 8*a*.

EXAMPLE 4

Electrodeposition of Pt Nanowires on Atomic Force Microscopy Probe Tips

Figure 9A:
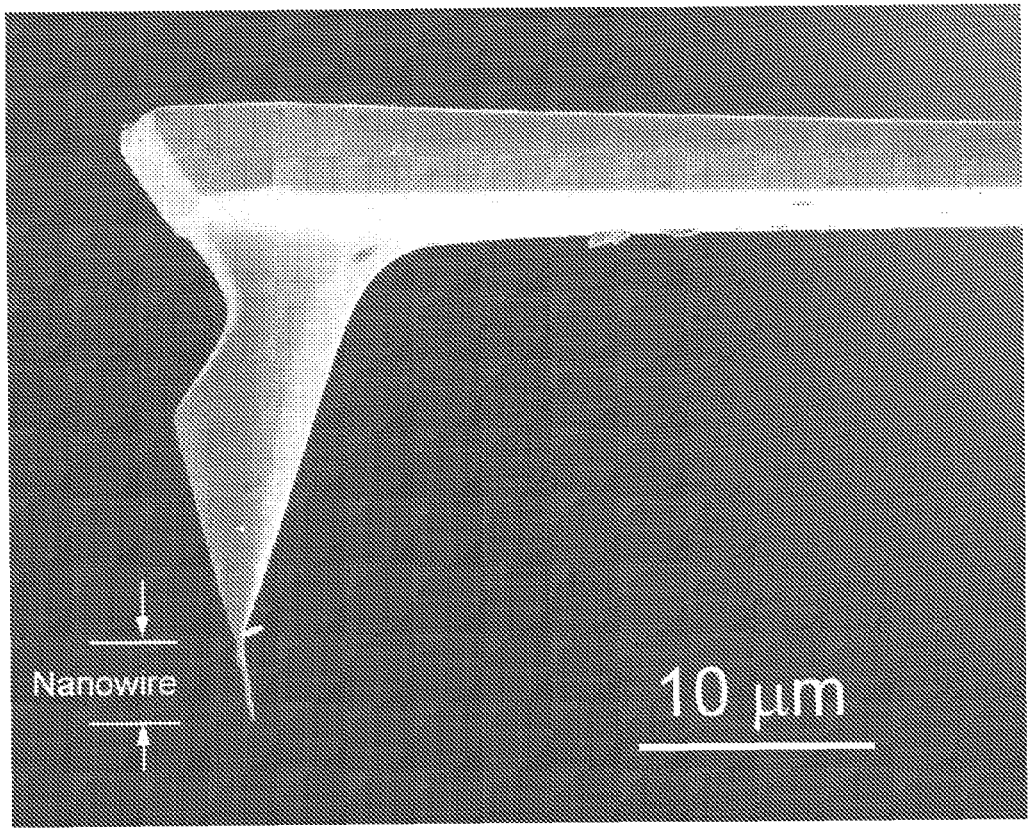
FIG. 9*a* is an SEM image showing an AFM tip modified through the direct deposition of a Pt nanowire off the apex of the tip end.
Figure 9B:
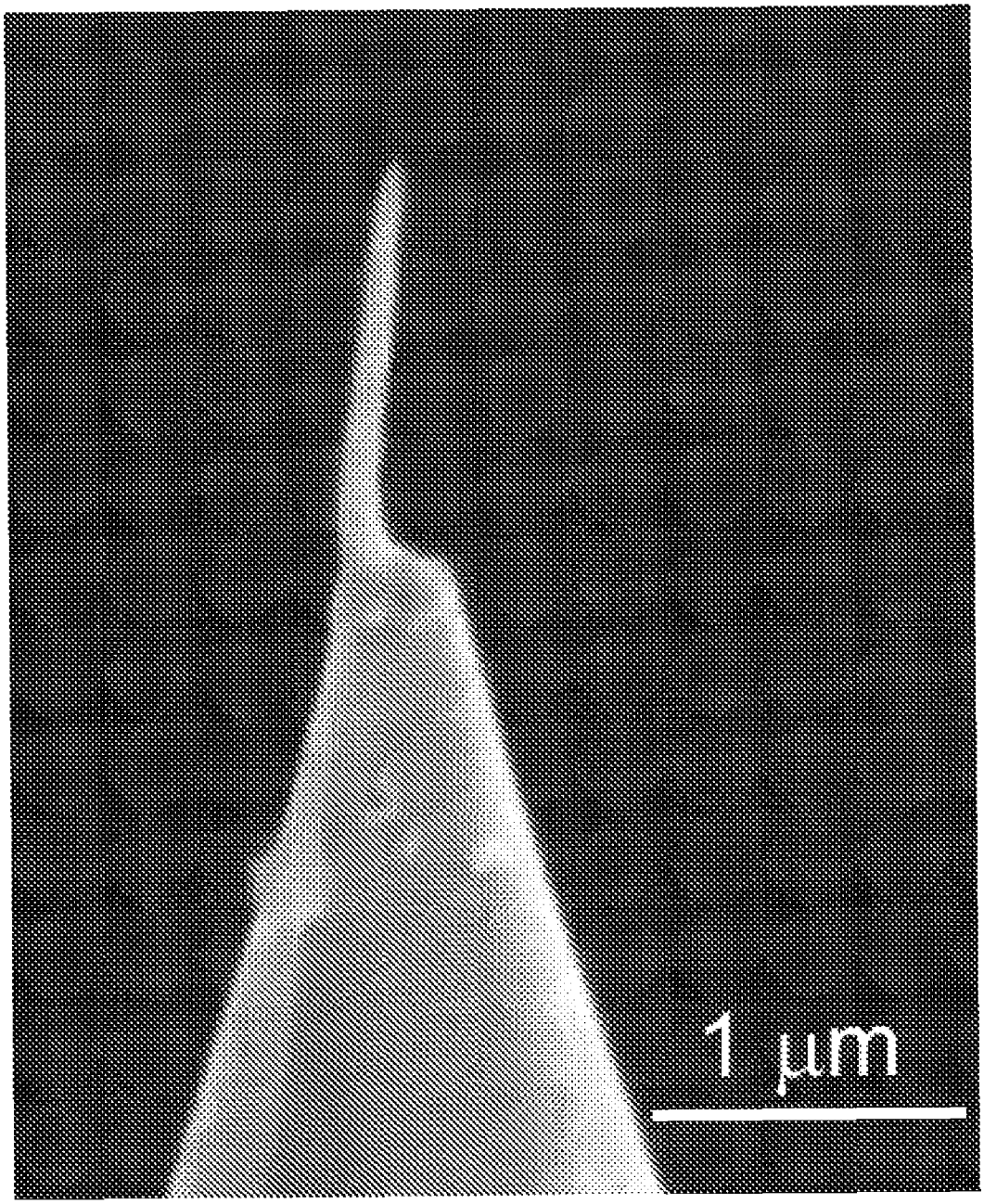
FIG. 9*b* is an SEM image showing another modified AFM tip with a Pt nanowire.

The described electrodeposition strategy was applied to deposit individual Pt nanowires off atomic force microscopy (AFM) probe tips for making high aspect ratio and conductive probes for critical metrology imaging and nanoscale electrical probing applications. To deposit a Pt nanowire onto an AFM probe tip, a commercially available conductive AFM probe was used as a substrate, and the pipette having an aperture diameter of ~100 nm was aligned counter to and perpendicular to the AFM cantilever. The AFM probe (including the tip) was coated with a thin film of metal believed to be approximately 10 nm thick. The pipette was then brought into contact with the very end of the AFM probe tip, and the previously-described procedure was applied to grow a nanowire off the AFM probe tip. When the cantilever is sufficiently flexible, the pullback speed is increased in stages until the desired pullback speed is reached. The gradual increase in pullback speed prevents breakage during growth of the nanowire. FIGS. 9*a* and 9*b* show the fabricated AFM probes deposited with Pt nanowires. In FIG. 9*a*, the deposited nanowire is 4 μm long and 190 nm in diameter. In FIG. 9*b*, the deposited nanowire is about 80 nm in diameter

EXAMPLE 5

Figure 10:
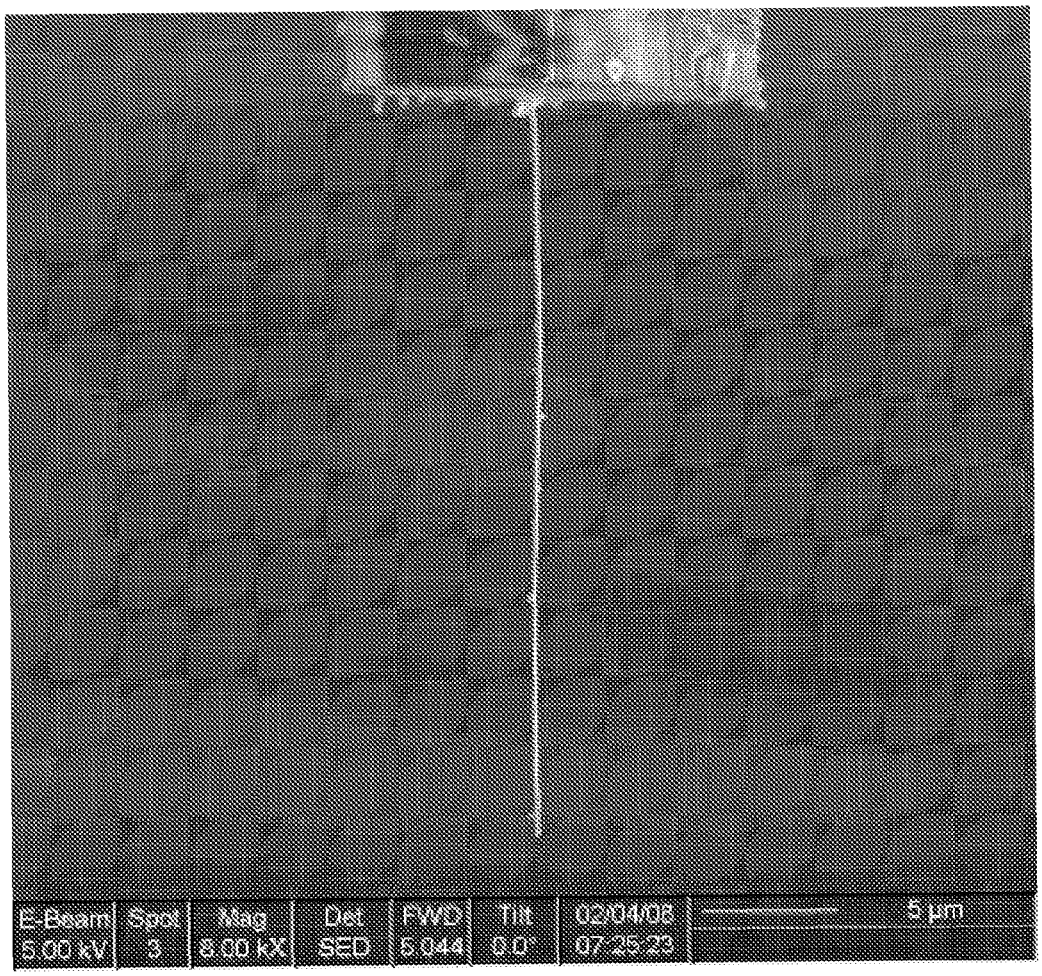
FIG. 10 is an SEM image showing a Pt nanowire grown off an Au microelectrode encapsulated inside a glass pipette.

Fabrication of Insulated Nanowire Electrodes for Biological and Cellular Probing and Electrochemical Analysis The described electrodeposition strategy was applied to deposit individual Pt nanowire off an insulated microelectrode seamlessly encapsulated inside a glass micropipette. The fabrication involves two general steps; one is to fabricate a microelectrode encapsulated inside a glass micropipette. The encapsulation provides the physical and electrical insulation to the embedded microelectrode. The microelectrode runs through the pipette and is accessible for making electrical connections to external measurement devices. The other step is to deposit a Pt nanowire off the exposed microelectrode at the end of the pipette. The first step is realized by inserting a commercially-available microsized (~15 micrometers in diameter) Au wire into a ~1 mm diameter glass tube, and then pulling the glass tube upon heating with a pipette puller. This process yields a pipette having a reduced tip diameter of ~ several micrometers, which encapsulates an Au wire reduced significantly in diameter as well. The tip end with the Au wire is gently polished to form a flat end encapsulating a flat Au microelectrode. The second step then involves the use of the electrodeposition procedure to grow a Pt nanowire off the flat Au microelectrode at the end of the pipette. FIG. 10 shows the nanowire (lower portion of image) grown on a microelectrode encapsulated inside a glass pipette (upper portion of image). The Pt nanowire is 30 μm in length and ~250 nm in diameter. The glass pipette tip has a diameter of ~15 μm, and the Au microelectrode encapsulated inside the glass pipette has a diameter of ~3 μm. The electrochemical sensing capability of such a nanowire probe is fully characterized and verified with cyclic voltammetry measurement in electrolyte solutions. Such a nanowire electrode can be used for biological and cellular probing, where the nanowire can be used to penetrate through cell membrane, and to apply electric pulses and measure electrochemical potentials in local nanoscale environments

We claim:

1. A method for forming an elongated structure of a selected material, the structure extending at least partially upwards from the surface of a substrate, the method comprising the steps of:

a. providing an electrically conducting substrate;

b. providing an electrolyte reservoir having a dispensing end and an aperture located at the dispensing end, the size of the aperture being less than 5 micrometers, the reservoir containing i. an electrolyte solution comprising at least one ionic component;

the ionic component capable of being electrodeposited to form the selected material; and ii. a reservoir electrode in electrical contact with the electrolyte solution;

c. applying a potential difference between the reservoir electrode and the substrate such that the substrate has the opposite charge to the ionic component and the reservoir electrode has the same charge as the ionic component, the variation in the potential difference being less than 2%;

d. bringing the aperture of the electrolyte reservoir sufficiently close to the substrate to establish a meniscus between the dispensing end of the reservoir and the substrate, thereby establishing a volume of electrolyte solution external to the reservoir between the dispensing end of the reservoir and the substrate and to establish an ionic current between the reservoir electrode and the substrate, thereby electrodepositing the selected material on the substrate; and e. increasing the vertical separation between the reservoir and the substrate while maintaining an ionic current therebetween, thereby electrodepositinq a wire of the selected material which extends at least partially upwards from the surface of the substrate, wherein the current is constant to within 15% after an initial stabilization period, the separation rate of the reservoir and the substrate is selected to be in the range between 50 nm/s and 500 nm/s and the motion of the reservoir and the electrodeposition rate are synchronized to maintain the meniscus between the dispensing end of the reservoir and the electrodeposited wire, thereby maintaining a volume of electrolyte solution external to the reservoir between the dispensing end of the reservoir and the electrodeposited material.

2. The method of claim 1, wherein the lateral dimension of the structure is from 1 nm to 1000 nm.

3. The method of claim 1, wherein the lateral dimension of the structure is from 50 nm to 750 nm.

4. The method of claim 1, wherein the selected material is a metal and the ionic component is a metal ion.

5. The method of claim 1, wherein the selected material is a conducting polymer and ionic component is a monomer comprising an ionic group.

6. The method of claim 1, wherein the electrolyte solution comprises a plurality of ionic components which can be electrodeposited to form the selected material.

7. The method of claim 6, wherein the selected material is a compound semiconductor.

8. The method of claim 6, wherein the selected material is a metal alloy.

9. The method of claim 1, wherein the electrical current between the reservoir electrode and the substrate is maintained at a value which is constant within 10% after an initial stabilization period.

10. The method of claim 1, wherein in step e) the rate of separation between the reservoir and the substrate is constant.

11. The method of claim 1, wherein in step e) the rate of separation between the reservoir and the substrate is gradually increased, then held at a constant value.

12. The method of claim 2, wherein the structure is a nanowire.

13. The method of claim 1, wherein the structure has an aspect ratio of at least 5.

14. The method of claim 13, wherein the structure has an aspect ratio of at least 10.

15. The method of claim 1, wherein the electrolyte solution is an aqueous solution and the method further comprises the step of controlling the humidity surrounding the substrate and the electrolyte reservoir, the relative humidity level being greater than 20%, thereby preventing blockage of the aperture by crystallization of the electrolyte solution.

16. A method for making a modified scanning probe microscopy probe, the method comprising the steps of:

a. providing a scanning probe microscopy probe comprising a cantilever and a first tip portion attached to the cantilever, the cantilever and the first tip portion being coated with a metallic thin film;

b. forming a metallic nanowire at the apex of the first tip portion by the method of claim 1, thereby forming a second tip portion attached to the first tip portion.

17. A method for making an electrically conducting nanoprobe, the method comprising the steps of:

a. providing an elongated metallic conductor having a lateral dimension greater than 1 micron and a first electrically insulating layer covering the side surface of the elongated conductor;

b. forming a metallic nanowire at one end of the metallic conductor by the method of claim 1;

c. applying a second electrically insulating layer covering the nanowire and the joint between the nanowire and the conductor, thereby electrically insulating the nanowire;

d. removing a segment of the insulated nanowire from its free end, thereby exposing the metallic nanowire.

18. The method of claim 1, wherein the size of the aperture is less than or equal to 2 micrometers.

* * * * *